US011378326B2

(12) United States Patent
Kato et al.

(10) Patent No.: US 11,378,326 B2
(45) Date of Patent: Jul. 5, 2022

(54) SUBLIMATION DEFROSTING METHOD, SUBLIMATION DEFROSTING DEVICE, AND COOLING DEVICE

(71) Applicant: MAYEKAWA MFG. CO., LTD., Tokyo (JP)

(72) Inventors: Masashi Kato, Tokyo (JP); Kosaku Nishida, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 946 days.

(21) Appl. No.: 16/081,418

(22) PCT Filed: Oct. 6, 2016

(86) PCT No.: PCT/JP2016/079859
§ 371 (c)(1),
(2) Date: Aug. 31, 2018

(87) PCT Pub. No.: WO2017/175411
PCT Pub. Date: Oct. 12, 2017

(65) Prior Publication Data

US 2021/0180852 A1 Jun. 17, 2021

(30) Foreign Application Priority Data

Apr. 7, 2016 (JP) ..... JP2016-077466
Apr. 7, 2016 (JP) ..... JP2016-077467

(51) Int. Cl.
*F25D 21/08* (2006.01)
*F25D 21/00* (2006.01)
*F28F 17/00* (2006.01)

(52) U.S. Cl.
CPC ..... *F25D 21/08* (2013.01); *F25D 21/002* (2013.01); *F28F 17/00* (2013.01)

(58) Field of Classification Search
CPC ..... F25D 21/08; F25D 21/002; F25D 21/06; F28F 17/00; F25B 47/02
(Continued)

(56) References Cited

U.S. PATENT DOCUMENTS 9,863,677 B2 1/2018 Koshikawa et al.
2007/0130966 A1* 6/2007 Kim ..... F25D 21/08 62/150
(Continued)

FOREIGN PATENT DOCUMENTS

EP 2940410 11/2015
JP S4976143 7/1974
(Continued)

OTHER PUBLICATIONS

"Office Action of Japan Counterpart Application," dated Dec. 7, 2018, with English translation thereof, p. 1-p. 11.
(Continued)

*Primary Examiner* — Steve S Tanenbaum
(74) *Attorney, Agent, or Firm* — JCIPRNET

(57) ABSTRACT

There is provided a sublimation defrosting method for removing a frost layer adhering to a cooling surface for cooling a to-be-cooled gas, including a heating/temperature-rising step of heating an adhesion portion of the cooling surface, to which the frost layer adheres, to rise a temperature of the adhesion portion by a heat source located on an adhesion portion side with respect to the frost layer, under a temperature condition below a melting point of the frost layer.

19 Claims, 10 Drawing Sheets

(58) Field of Classification Search
USPC ..... 62/80
See application file for complete search history.

(56) References Cited

U.S. PATENT DOCUMENTS

| | | | | |
|---|---|---|---|---|
| 2011/0197605 | A1 | 8/2011 | Suzuki et al. | |
| 2014/0174100 | A1* | 6/2014 | Biotti | F25D 17/042 62/3.4 |

FOREIGN PATENT DOCUMENTS

| | | | | |
|---|---|---|---|---|
| JP | S4976143 | A | * | 7/1974 |
| JP | S5190172 | | | 7/1976 |
| JP | S5190172 | U | * | 7/1976 |
| JP | H11118302 | | | 4/1999 |
| JP | 2001004254 | | | 1/2001 |
| JP | 2008064326 | | | 3/2008 |
| JP | 2008075963 | | | 4/2008 |
| JP | 2008175468 | | | 7/2008 |
| JP | 2011169493 | | | 9/2011 |
| JP | 2012072981 | | | 4/2012 |
| JP | 5944058 | | | 7/2016 |
| WO | 2015093235 | | | 6/2015 |

OTHER PUBLICATIONS

"International Preliminary Report on Patentability; this report contains the following items :Form PCT/IB/338, PCT/IB/373, PCT/ISA237(cover sheet), PCT/ISA237(Box No. I),PCT/ISA237(Box No. V)", dated Oct. 18, 2018, which is English translation of "Written Opinion of the International Searching Authority", p. 1-p. 17.

"Search Report of Europe Counterpart Application", dated Feb. 5, 2019, p. 1-p. 7.

"International Search Report (Form PCT/ISA/210) of PCT/JP2016/079859," dated Dec. 20, 2016, with English translation thereof, pp. 1-4.

"Office Action of China Counterpart Application," with English translation thereof, dated Dec. 13, 2019, p. 1-p. 22.

* cited by examiner

RELATIONSHIP BETWEEN SUBLIMATION TIME AND MAIN FLOW SPEED

SUBLIMATION DEFROSTING METHOD, SUBLIMATION DEFROSTING DEVICE, AND COOLING DEVICE

CROSS-REFERENCE TO RELATED APPLICATION

This application is a 371 application of the international PCT application serial no. PCT/JP2016/079859, filed on Oct. 6, 2016, which claims the priority benefit of Japan application no. 2016-077466, filed on Apr. 7, 2016, and Japan application no. 2016-077467, filed on Apr. 7, 2016. The entirety of each of the above-mentioned patent applications is hereby incorporated by reference herein and made a part of this specification.

TECHNICAL FIELD

The present disclosure relates to a defrosting method for removing frost adhering to a cooling surface of a cooling device or the like by sublimation, a defrosting device, and a cooling device including the defrosting device.

BACKGROUND ART

In a conventional method for removing a frost layer adhering to a cooling pipe of a cooler provided in a freezer or the like, usually, the frost layer is heated and melted after the cooler is stopped.

For instance, Patent Document 1 discloses a method in which the frost layer is melted by spraying water. Patent Document 2 discloses a method in which the frost layer is heated and melted with a heater.

However, these methods need to stop the operation of the cooler and need to melt all frost, requiring high thermal energy. Moreover, it takes time to dry or remove water resulting from the melted frost layer, which elongates the time for stopping the cooler.

There is also a method in which the frost layer adhering to the cooler is removed by jetting a strong air flow. In this method, however, strongly adhering frost remains on the surface of a cooling pipe. This frost can grow and clog the cooler. It is therefore necessary to take measures, for instance, increasing a distance between cooling pipes, which leads to the increase in size of the cooling device.

In recent years, as described in Patent Documents 3 and 4, a defrosting method in which the frost layer adhering to the cooling pipe is removed by sublimation to prevent the generation of melt water is also suggested. In Patent Documents 3, a desiccant rotor dehumidifies a cooling space below the saturation water vapor pressure and thereby enables sublimation defrosting. In Patent Documents 4, a heater provides sublimation latent heat necessary for sublimation to the frost layer adhering to the cooling pipe, thereby performing sublimation defrosting.

CITATION LIST

Patent Literature

Patent Document 1: JP2008-175468A
Patent Document 2: JP2008-75963A
Patent Document 3: JP2012-72981A
Patent Document 4: JPH11-118302A

SUMMARY

Problems to be Solved

As described above, the defrosting methods using melting disclosed in Patent Document 1 and Patent Document 2 have various problems: the operation of the cooler needs to be stopped; and it takes time to remove the melt water.

The defrosting method using sublimation disclosed in Patent Document 3 is costly, for the dehumidifier is necessary to keep the humidity of a gas (air) to be cooled below saturation. Further, the defrosting methods disclosed in Patent Documents 3 and 4 require a large amount of heat to sublimate the whole frost layer, and the defrosting efficiency is not high.

In view of the above problems, an object of some embodiments is to improve the defrosting efficiency with low-cost means in a sublimation defrosting method which allows defrosting without stopping the operation of the cooling device.

Solution to the Problems (1) A defrosting method according to some embodiments is a sublimation defrosting method for removing a frost layer adhering to a cooling surface for cooling a to-be-cooled gas; the method comprising a heating/temperature-rising step of heating an adhesion portion of the cooling surface, to which the frost layer adheres, to rise a temperature of the adhesion portion by a heat source located on an adhesion portion side with respect to the frost layer, under a temperature condition below a melting point of the frost layer.

To sublimate the frost layer, it is required that a space around the frost layer has unsaturated water vapor pressure, and sublimation latent heat is present.

In the above method (1), heating and temperature-rising is performed with the heat source located on an adhesion portion side with respect to the frost layer. Thus, only the adhesion portion of the frost layer and the to-be-cooled gas around the adhesion portion can be heated without considerably heating the main flow of the to-be-cooled gas. This allows a root-side region of the frost layer to be heated earlier, and the root-side region meets the aforementioned sublimation conditions earlier. Consequently, sublimation occurs around the root-side region.

Accordingly, it is possible to achieve defrosting without stopping the operation during a process of cooling a to-be-cooled material by a cooling space formed by the cooling surface, for instance, during the operation of the cooling device to cool the to-be-cooled gas by the cooling surface. Moreover, since melt water is not generated during defrosting, it is unnecessary to remove the melt water.

Sublimation mainly performed on the root-side region of the frost layer weakens the adhesion strength of the frost layer, thus facilitating defrosting. The frost layer with weakened adhesion strength can be removed by external force, which eliminates need for sublimating the whole frost layer. Thus, it is possible to reduce the amount of heat necessary for sublimation, and it is possible to shorten the defrosting time. It is therefore possible to reduce the amount of heat necessary for sublimation and improve the defrosting efficiency, compared with the defrosting methods disclosed in Patent Documents 3 and 4.

Further, since the frost layer can be rooted up with the root-side region, it is possible to prevent the frost layer from clogging a space between cooling flow paths. This can eliminate a wide distance between the cooling flow paths, thus making the cooling device containing the cooling flow paths compact.

In addition, heating the root-side region of the frost layer forms an unsaturated atmosphere with minute vapor around the root-side region. This enables sublimation in each case where a space around the cooling surface is saturated or unsaturated.

(2) In an embodiment, in the above method (1), the method further comprises a cooling step of keeping a tip-side region of the frost layer adhering to the adhesion portion at a lower temperature than a raised temperature of the adhesion portion.

In the cooling step, the tip-side region of the frost layer is kept at a lower temperature, in some way, than a raised temperature of the cooling surface heated in the heating/temperature-rising step to form a temperature gradient in which the temperature of the frost layer gradually decreases from the root-side region to the tip-side region. Thus, the root-side region preferentially meets the sublimation conditions more easily than the tip-side region.

In order to efficiently sublimate the root-side region of the frost layer in a short time, it is effective to maintain the temperature around the adhesion portion high and other portions low. To this end, advantageously, a large temperature difference is made between the root-side region and the tip-side region to form a large temperature gradient over the entire frost layer.

(3) In an embodiment, in the above method (1) or (2), the method further comprises a sublimation step of sublimating a root-side region of the frost layer adhering to the adhesion portion heated in the heating/temperature-rising step so as to reduce an adhesion area where the root-side region adheres to the adhesion portion.

In the above method (3), the adhesion strength of the frost layer can be reduced by reducing the adhesion area where the frost layer adheres to the adhesion portion. This facilitates defrosting.

In the sublimation step, the frost layer may be removed from the adhesion portion by making the adhesion area of the root-side region of the frost layer at the adhesion portion zero. Alternatively, before the adhesion area is made zero, the frost layer may be peeled off by some physical action such as, for instance, scraping, vibration, gravity, electromagnetic force. Thereby, it is possible to shorten the defrosting time and improve the defrosting efficiency.

(4) In an embodiment, in the above method (1) or (2), the cooling step includes keeping the tip-side region of the frost layer at a lower temperature than the adhesion portion by a cooling space formed around the cooling surface.

In the above method (4), since the cooling space formed around the adhesion portion is used as a cooling source for cooling the tip-side region of the frost layer, it is unnecessary to provide a specific cooling source, and it is possible to achieve defrosting during a process of cooling the to-be-cooled material by the cooling surface.

(5) In an embodiment, in the above method (4), the adhesion portion is divided into a plurality of sections, and the heating/temperature-rising step and the sublimation step are performed for each of the plurality of sections while the cooling space is formed around the cooling surface by the cooling step.

In the above method (5), since defrosting is performed for each section of the adhesion portion, it is possible to achieve defrosting without disturbing the cooling process of the to-be-cooled material.

(6) In an embodiment, in any one of the above methods (3) to (5), the method further comprises a peeling step of applying physical force to the frost layer with the adhesion area reduced by the sublimation step to peel off the frost layer from the adhesion portion.

In the above method (6), before the adhesion area where the frost layer adheres to the adhesion portion is made zero and before the whole of the frost layer is sublimated, some physical action such as scraping, vibration, gravity, or electromagnetic force is applied to the frost layer, and thereby the frost layer is peeled off. Thus, it is possible to reduce the amount of heat necessary for sublimation. Further, it is possible to shorten the defrosting time and improve the defrosting efficiency.

(7) In an embodiment, in the above method (6), the peeling step includes forming a flow of the to-be-cooled gas along the adhesion portion and peeling off the frost layer from the adhesion portion by a wind pressure of the to-be-cooled gas.

In the above method (7), a convection of the to-be-cooled gas formed to increase the cooling effect on the to-be-cooled material can also be used to peel off the frost layer. Thus, it is unnecessary to provide additional installation and operation for the peeling step.

(8) In an embodiment, in any one of the above methods (1) to (7), in the heating/temperature-rising step, a temperature rising rate of the adhesion portion is increased as a temperature of the frost layer increases.

According to the findings obtained by the inventors, the adhesion area reduction effect of the frost layer in the sublimation step is not improved unless the temperature rising rate in the heating/temperature-rising step is increased with the increase in temperature of the frost layer. The reason is considered that, in the heating/temperature-rising step, a higher temperature of the frost layer makes it difficult to make a temperature difference between the root-side region and the tip-side region, as well as a higher temperature of the frost layer coarsens the frost crystals and thus increases the thermal conductivity, so that the temperature distribution inside the frost layer approximates to equilibrium in a state where the temperature difference between the root-side region and the tip-side region is small.

When the temperature rising rate of the adhesion portion is increased with the increase in temperature of the frost layer before the heating/temperature-rising step so that the temperature gradient between the root-side region and the tip-side region is increased, it is possible to promote sublimation of the root-side region.

(9) In an embodiment, in any one of the above methods (1) to (8), in the heating/temperature-rising step, a temperature rising rate of the adhesion portion is increased as a thickness of the frost layer decreases.

If the frost layer is thin, the temperature of the tip-side region is also raised in a short time due to thermal conduction. This makes it difficult to form the temperature gradient for promoting sublimation of the root-side region of frost. When the temperature rising rate of the adhesion portion is increased, as the frost layer is thin, so as to form the temperature gradient, it is possible to promote sublimation of the root-side region of the frost layer.

(10) In an embodiment, in any one of the above methods (1) to (9), in the heating/temperature-rising step, instantaneous temperature-rising is intermittently performed on the adhesion portion.

The temperature gradient formed in the frost layer approximates to equilibrium due to heat transfer inside the frost layer over time. When instantaneous temperature-rising is intermittently performed on the adhesion portion to intermittently form an instantaneous temperature gradient, it is possible to maintain sublimation of the root-side region.

In addition, since the instantaneous heating generates only small amount of heat, it is possible to prevent the increase in temperature of the cooling space formed around the cooling surface.

(11) In an embodiment, in any one of the above methods (1) to (10), in the heating/temperature-rising step, the temperature of the adhesion portion is raised by supplying a heated refrigerant to a cooling flow path which forms the cooling surface.

With the above method (11), it is possible to heat the adhesion portion of the frost layer without providing an additional installation in an existing cooling space, and thus it is possible to reduce the cost.

This heating means allows defrosting only at a partial region of the cooling flow path while the other region is under cooling operation. Thus, it is possible to achieve defrosting while cooling operation is continued.

(12) A defrosting device according to some embodiments is a sublimation defrosting device for removing a frost layer adhering to a cooling surface for cooling a to-be-cooled gas; the device comprising: a heating/temperature-rising part configured to heat an adhesion portion of the cooling surface, to which the frost layer adheres, to rise a temperature of the adhesion portion, with a heat source located on an adhesion portion side with respect to the frost layer; a temperature sensor for detecting the temperature of the adhesion portion; and a control part into which a detection value of the temperature sensor is input and which operates the heating/temperature-rising part so as to rise the temperature of the adhesion portion under a temperature condition below a melting point of the frost layer and form a temperature gradient from a root-side region to a tip-side region of the frost layer.

In the above configuration (12), the heating/temperature-rising part heats and rises the temperature of the adhesion portion so as to establish the conditions where sublimation can occur around the adhesion portion. Thus, sublimation can occur mainly around the root-side region of the frost layer.

Further, the control part controls the operation of the heating/temperature-rising part, based on a temperature detection value of the adhesion portion so as to form the temperature gradient where the temperature gradually decreases from the root-side region to the tip-side region of the frost layer. This promotes sublimation around the root-side region and reduces the adhesion area of the root-side region at the adhesion portion, thus facilitating defrosting.

(13) In an embodiment, in the above configuration (12), the device comprises a cooling part configured to cool the tip-side region of the frost layer, wherein the control part is configured to operate the cooling part so as to cool the tip-side region and thereby form the temperature gradient.

In the above configuration (13), the above temperature gradient can be easily formed by cooling the tip-side region of the frost layer by the cooling part.

(14) In an embodiment, in the above configuration (12) or (13), the device further comprises a flow formation part for forming a flow of the to-be-cooled gas along the cooling surface.

In the above configuration (14), a wind pressure of the to-be-cooled gas formed by the flow formation part enables, before the adhesion area of the root-side region of the frost layer at the adhesion portion is made zero, the frost layer with a reduced adhesion area to be peeled off with the root-side region. Thus, it is possible to reduce the amount of heat necessary for sublimation. Further, it is possible to shorten the defrosting time and improve the defrosting efficiency.

(15) In an embodiment, in any one of the above configurations (12) to (14), the heating/temperature-rising part is a high-frequency current dielectric part configured to apply a high-frequency current to the adhesion portion.

In the above configuration (15), the current is concentrated to the adhesion portion by the skin effect of the high-frequency current. Thus, it is possible to improve the heating efficiency of the frost layer adhering to the adhesion portion and save energy.

(16) In an embodiment, in any one of the above configurations (12) to (14), the device comprises an electrically conductive material layer formed on the adhesion portion; and an electrically insulating layer formed between the electrically conductive material layer and a cooling flow path which forms the cooling surface, wherein the heating/temperature-rising part includes a current-carrying part configured to apply a current to the electrically conductive material layer.

In the above configuration (16), the electrically insulating layer provided between the electrically conductive material layer and the cooling flow path allows the current to concentratedly flow through the electrically conductive material layer during defrosting. Thereby, it is possible to improve the heating efficiency. Additionally, thinning the electrically conductive material layer reduces thermal energy required for heating, thus saving energy.

(17) In an embodiment, in the above configuration (16), the device further comprises a heat insulating layer interposed between the electrically insulating layer and the cooling flow path.

In the above configuration (17), the heat insulating layer provided between the electrically insulating layer and the cooling flow path suppresses heat transfer to the cooling flow path during defrosting. Thereby, it is possible to increase the temperature rising rate of the adhesion portion during defrosting and improve the heat efficiency.

Further, minimizing the thickness of the heat insulating layer prevents the reduction in cooling efficiency against the to-be-cooled gas around the adhesion portion.

(18) A cooling device according to an embodiment comprises: a housing which forms a cooling space therein; a cooler which has a cooling surface for cooling the to-be-cooled gas and forms the cooling space by the cooling surface; and the sublimation defrosting device with any one of the above configurations (12) to (17), wherein the cooling device is configured to cool a to-be-cooled material contained in the cooling space.

In the above configuration (18), since the defrosting device with any one of the above configurations (12) to (17) is included, it is possible to remove frost adhering to the cooling surface without stopping the cooling device under operation. Moreover, since melt water is not generated during defrosting, it is unnecessary to remove the melt water.

Additionally, since the root-side region of the frost layer is mainly sublimated by the defrosting device, it is unnecessary to sublimate the whole frost layer. Thus, it is possible to reduce the necessary heat amount, and it is possible to shorten the defrosting time and improve the defrosting efficiency.

Further, since the frost layer can be rooted up with the root-side region, there is no risk that the frost layer clogs the space between cooling flow paths forming the cooling surface. This can eliminate a wide distance between the cooling flow paths, thus making the cooler containing the cooling flow paths compact.

Advantageous Effects

According to some embodiments, it is possible to remove frost without stopping the operation of a cooling device for cooling a material, and it is also possible realize simple and low-cost defrosting means.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
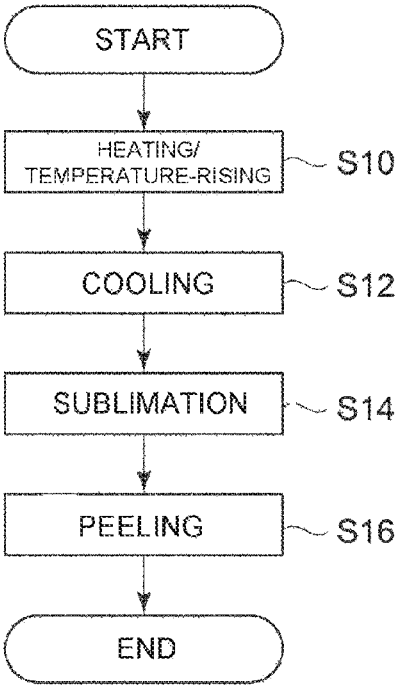
FIG. 1 is a flowchart of a defrosting method according to an embodiment.
Figure 2:
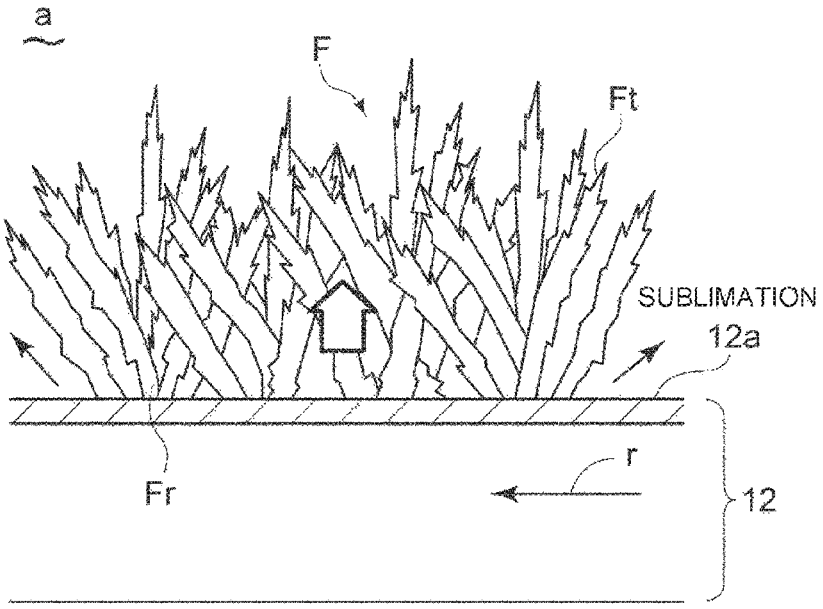
FIG. 2 is a cross-sectional view showing a defrosting method according to an embodiment.

FIG. 1 is a flowchart of a defrosting method according to an embodiment. FIG. 2 shows a cooling surface 12*a* to which a frost layer F adheres according to an embodiment.

The defrosting method according an embodiment is to remove the frost layer F adhering to the cooling surface 12*a* for cooling a to-be-cooled gas a. The method includes a heating/temperature-rising step S10 as shown in FIG. 1. In the heating/temperature-rising step S10, an adhesion portion of the cooling surface 12*a* to which the frost layer F adheres is heated to raise a temperature of the adhesion portion by a heat source located on an adhesion portion side with respect to the frost layer, under a temperature condition below the melting point of the frost layer.

In an embodiment, the cooling surface 12*a* is formed at an outer surface of a cooling flow path 12 such as a cooling pipe. In the heating/temperature-rising step S10, since heating and temperature-rising is performed with the heat source located on a side adjacent to the adhesion portion of the cooling surface 12*a* to which the frost layer F adheres, only the adhesion portion can be heated without heating the to-be-cooled gas a. This allows a root-side region Fr of the frost layer F to be heated earlier, and the root-side region Fr meets the sublimation conditions earlier. Consequently, sublimation occurs around the root-side region Fr.

The heating/temperature-rising step S10 weakens the adhesion strength of the frost layer to the adhesion portion, facilitating defrosting. The frost layer with weakened adhesion strength can be removed by external force, which eliminates need for sublimating the whole frost layer. Thus, it is possible to reduce the amount of heat necessary for sublimation, and it is possible to shorten the defrosting time. It is therefore possible to reduce the amount of heat necessary for sublimation and improve the defrosting efficiency, compared with the defrosting methods disclosed in Patent Documents 3 and 4.

In addition, heating the root-side region Fr of the frost layer F forms an unsaturated atmosphere with minute vapor around the root-side region Fr. This enables sublimation in each case where a cooling space around the cooling surface is saturated or unsaturated.

With the above defrosting method, it is possible to achieve defrosting, in a cooling device for cooling a to-be-cooled material by the to-be-cooled gas a, without stopping the operation of the cooling device. Moreover, since melt water is not generated during defrosting, it is unnecessary to remove the melt water. Moreover, since the root-side region Fr of the frost layer F is mainly sublimated, it is unnecessary to sublimate the whole frost layer. Thus, it is possible to reduce the amount of heat necessary for sublimation, and it is possible to shorten the defrosting time.

Further, since the frost layer F can be rooted up with the root-side region Fr, it is possible to prevent the frost layer F from clogging a space between cooling flow paths in a case where a plurality of cooling flow paths 12 is disposed. This can eliminate a wide distance between the cooling flow paths, thus making the cooling device having the cooling flow paths compact.

In an embodiment, as shown in FIG. 2, the cooling flow path 12 is a cooling pipe through which a refrigerant r flows, and the cooling surface 12*a* is formed at an outer surface of the cooling pipe. Herein, the "refrigerant" includes brine.

In an embodiment, the cooling flow path 12 is provided, for instance, within a freezer and cools the to-be-cooled gas a in the freezer to 0° C. or lower to keep a to-be-cooled material contained in the freezer cold. During keeping the material in cold, the frost layer F adheres to the cooling surface 12*a* and grows.

In an embodiment, the cooling flow path is provided within a housing of a cooler provided in a freezer and cools the to-be-cooled gas a introduced into the housing to 0° C. or lower to keep a to-be-cooled material contained in the freezer cold.

In an embodiment, the cooling flow path 12 is a heat exchanger flow path which is formed in a heat exchanger and through which a heat exchanging medium flows.

In an embodiment, a tip-side region Ft of the frost layer F adhering to the cooling surface 12*a* is kept at a lower temperature than the raised temperature of the adhesion portion (cooling step S12).

In the cooling step S12, the tip-side region Ft of the frost layer F is kept at a lower temperature, in some way, than the raised temperature of the cooling surface 12*a* heated in the heating/temperature-rising step S10 to form a temperature gradient in which the temperature of the frost layer F gradually decreases from the root-side region Fr to the tip-side region Ft. Thus, the root-side region Fr meets the sublimation conditions more easily than the tip-side region Ft, and sublimation occurs around the root-side region Fr.

In the cooling step S12, as exemplary means for keeping the tip-side region Ft at a lower temperature than the adhesion portion 12*a*, for instance, there may be mentioned a method in which the tip-side region Ft is cooled by convective heat transfer of the to-be-cooled gas a cooled by the cooling surface 12*a*; or a method in which a temperature gradient is formed during a shorter time, by the heat capacity of the frost layer itself, than a time for transferring heat of the root-side region Fr to the tip-side region Ft through thermal conduction inside the frost layer.

In an embodiment, the root-side region Fr of the frost layer F adhering to the adhesion portion 12*a* heated in the heating/temperature-rising step S10 is sublimated to reduce an adhesion area where the root-side region Fr adheres to the adhesion portion 12*a* (sublimation step S14).

In the sublimation step S14, the frost layer may be removed from the adhesion portion by making the adhesion area where the root-side region Fr adheres to the adhesion portion 12*a* zero. Alternatively, before the adhesion area is made zero, the frost layer F may be peeled off by some physical action such as, for instance, scraping, vibration, gravity, electromagnetic force. Thereby, it is possible to shorten the defrosting time and improve the defrosting efficiency.

Figure 3:
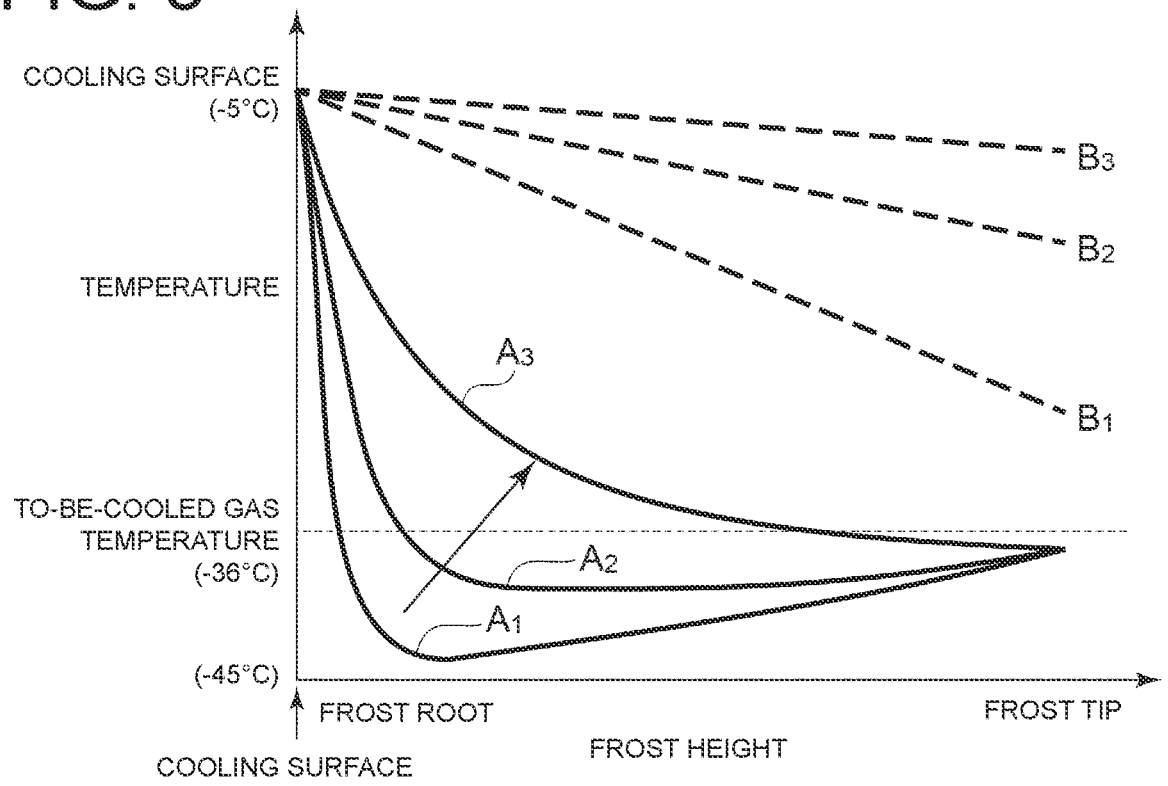
FIG. 3 is a diagram showing temperature gradient of a frost layer according to some embodiments.

FIG. 3 schematically shows some examples of the aforementioned temperature gradient. The horizontal axis of the graph shown in FIG. 3 represents a height of the frost layer F from the cooling surface 12*a*, and the vertical axis represents the temperature of the to-be-cooled gas a and of respective portions of the frost layer F. In one example using, for instance, a quick freezer, the cooling surface 12*a* is cooled to −45° C. by a refrigerant flowing through the cooling pipe, and the to-be-cooled gas a is cooled to −36° C. by the cooling surface 12*a*. During defrosting, the temperature of the cooling surface 12*a* is rapidly raised to −5° C. in the heating/temperature-rising step S10.

Line $A_1$ shows a temperature distribution immediately after temperature rising of the adhesion portion 12*a* which is rapidly heated to −5° C. in the heating/temperature-rising step S10. Starting with this line, the temperature distribution is changed by thermal conduction to line $A_2$ and then line $A_3$ over time. A cooling source at this time in the cooling step S12 is, for instance, the heat capacity of the frost layer itself or the to-be-cooled gas a at the time of cooling operation of the refrigerator.

To efficiently reduce the adhesion area by sublimation, it is desirable to make the temperature gradient large in the vicinity of the adhesion portion. To this end, rapid temperature rising to some extent, as shown in line $A_1$, is required. For instance, it is preferred that the temperature of the adhesion portion 12*a* is raised by heating in the heating/temperature-rising step S10 to around the melting point in a shorter time than a time for transmitting heat to the tip-side region Ft through thermal conduction inside the frost layer. It is ideal to keep the temperature distribution such as lines $A_1$ to $A_3$ immediately after heating and temperature rising, but this temperature distribution is temporary in transient change and thus cannot be kept.

Accordingly, in order to increase the proportion of a time during which the temperature distribution is relatively close to lines $A_1$ to $A_3$ to a time during which the temperature is raised, for instance, it is effective to intermittently repeat instantaneous heating and temperature rising in the heating/temperature-rising step S10. An effective cooling source at this time in the cooling step S12 is the to-be-cooled gas a at the time of cooling operation of the refrigerator.

In a case where an equilibrium temperature distribution determined by physical conditions of the frost layer (e.g., density, frost layer height, thermal conductivity) and conditions of the to-be-cooled gas a (wind speed, temperature), i.e., a temperature distribution as shown by lines $B_1$, $B_2$ and $B_3$ is kept to reduce the adhesion area, it is desirable to make a temperature difference between the root-side region Fr and the tip-side region Ft of the frost layer F large so as to efficiently reduce the adhesion area. In this case, for instance, it is effective that the temperature of the adhesion portion 12*a* is approximated to the melting point as close as possible within a controllable range in the heating/temperature-rising step S10, and the temperature of the to-be-cooled gas a used for cooling the tip-side region Ft is decreased as low as possible in the cooling step S12 while the wind speed of the to-be-cooled gas a is increased so that heat transfer coefficient is increased, and thereby the temperature of the tip-side region Ft is decreased as low as possible.

In a case where the to-be-cooled gas is air, as the temperature of the to-be-cooled gas rises, the saturation water vapor partial pressure rises. For instance, in terms of saturation pressure of ice, with respect to an air temperature of −40° C., the pressure is about 25 Pa at −30° C., about 90 Pa at −20° C., about 250 Pa at 10° C., and about 600 Pa at 0° C.; the pressure acceleratively rises as the temperature approximates to the melting point. As a difference of the saturation water vapor pressure increases, sublimation on the high-pressure side is promoted.

Thus, in order to efficiently reduce the adhesion area, it is desirable to rise the temperature of the adhesion portion 12*a* as rapidly as possible and approximate the temperature to the melting point as close as possible in the heating/temperature-rising step S10.

In an embodiment, in the cooling step S12, the tip-side region Ft of the frost layer F is kept at a lower temperature than the adhesion portion 12*a* by a cooling space formed around the adhesion portion 12*a*.

Thus, since the cooling space formed around the adhesion portion 12*a* is used as a cooling source for cooling the tip-side region Ft of the frost layer F, it is unnecessary to provide a specific cooling source, and it is possible to achieve defrosting during a process of cooling the to-be-cooled material by the cooling surface 12*a*.

In an embodiment, the cooling surface 12*a* is divided into a plurality of sections, and the heating/temperature-rising step S10 and the sublimation step S14 are performed for each section while the cooling space is formed around the cooling surface 12*a* by the cooling step S12.

Thus, since defrosting is performed for each section of the adhesion portion, it is possible to achieve defrosting without disturbing the cooling process of the to-be-cooled material.

Figure 4:
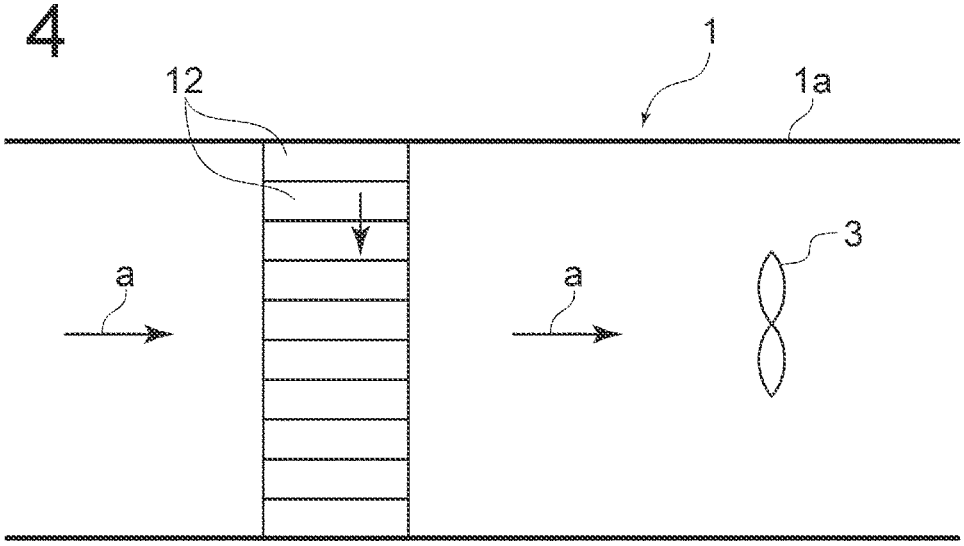
FIG. 4 is a schematic diagram showing a defrosting method according to an embodiment.

In an embodiment, as shown in FIG. 4, the cooling flow path 12 (e.g., cooling pipe) is provided within a duct 1*a* of a heat exchanger 1. In the interior of the duct 1*a*, a flow of the to-be-cooled gas a is formed by a blower 3. The heat exchanger 1 is, for instance, a cooler provided within a freezer, and a refrigerant is sent from a refrigerator (not shown) to the cooling flow path 12. The cooling flow path 12 is divided into a plurality of sections, and the removal of the frost layer adhering to the cooling flow path 12 is sequentially performed for each section while the refrigerator is continuously operated.

In an embodiment, as shown in FIG. 1, physical force is applied to the frost layer F whose adhesion area is reduced by the sublimation step S14 to peel off the frost layer F from the adhesion portion 12*a* (peeling step S16).

By the peeling step S16, before the adhesion area where the frost layer F adheres to the adhesion portion 12*a* is made zero and before the whole of the frost layer is sublimated, some physical action such as scraping, vibration, gravity, or electromagnetic force is applied to the frost layer, and thereby the frost layer F is peeled off. Thus, it is possible to reduce the amount of heat necessary for sublimation. Further, it is possible to shorten the defrosting time and improve the defrosting efficiency.

In an embodiment, in the peeling step S16, a flow of the to-be-cooled gas a is formed along the adhesion portion 12*a*, and the frost layer F whose adhesion area is reduced by the sublimation step S14 is peeled from the adhesion portion 12*a* by a wind pressure of the to-be-cooled gas a.

Thus, since the convection of the to-be-cooled gas a formed to increase the cooling effect on the to-be-cooled material can also be used to peel off the frost layer F, it is unnecessary to provide additional installation and operation for the peeling step S16.

In an embodiment, it is preferred that, in the heating/temperature-rising step S10, the temperature rising rate of the adhesion portion 12*a* is increased as the temperature of the frost layer F increases.

The reason is that, as described above, in the heating/temperature-rising step, a higher temperature of the frost layer increases the temperature of the adjacent to-be-cooled gas a and makes it difficult to increase a temperature difference between the heated adhesion portion 12*a* and the tip-side region Ft, as well as a higher temperature of the frost layer coarsens the frost crystals and thus increases the thermal conductivity, so that the temperature distribution inside the frost layer immediately approximates to equilibrium in a state where the temperature difference between the root-side region Fr and the tip-side region Ft is small, which makes it difficult to increase the temperature gradient unless the temperature rising rate is increased.

Accordingly, when the temperature rising rate of the adhesion portion 12*a* is increased with the increase in temperature of the frost layer before the heating/temperature-rising step so that the temperature gradient between the root-side region Fr and the tip-side region Ft is increased, it is possible to promote sublimation of the root-side region Fr.

In an embodiment, it is preferred that, in the heating/temperature-rising step S10, the temperature rising rate of the adhesion portion 12*a* is increased as the thickness of the frost layer F decreases.

If the frost layer F is thin, heat is transferred to the tip-side region Ft relatively quickly, and thus the temperature distribution approximates to equilibrium in a short time. Further, since the thermal conduction distance is short, the temperature difference between the root-side region Fr and the tip-side region Ft is hard to increase. As a result, a large temperature gradient cannot be obtained, and sublimation cannot be mainly caused in the root-side region Fr. That is, extra heat amount becomes necessary, and the adhesion area reduction efficiency (adhesion strength reduction efficiency) decreases.

In this context, increasing the temperature rising rate in the heating/temperature-rising step S10 forms a temperature distribution such as lines $A_1$ to $A_3$ in FIG. 3 in the frost layer F and improves the adhesion area reduction efficiency on the root-side region Fr, thus saving energy.

In an embodiment, in the heating/temperature-rising step S10, instantaneous temperature-rising is intermittently performed on the cooling surface 12*a*.

The temperature gradient, as shown by lines A1, A2, and A3, formed in the frost layer F approximates to equilibrium due to heat transfer inside the frost layer when the adhesion portion of the frost layer is kept in a heating state. In this context, when instantaneous temperature-rising is intermittently performed on the cooling surface 12*a*, it is possible to maintain sublimation of the root-side region Fr while preventing the increase in temperature of the to-be-cooled gas a.

Further, since the instantaneous heating generates only small amount of heat, it is possible to prevent the increase in temperature of the cooling space formed around the cooling surface 12*a*.

In an embodiment, in the heating/temperature-rising step S10, a heated refrigerant r is supplied to the cooling flow path 12 to rise the temperature of the adhesion portion 12*a*.

With this temperature rising means, it is possible to heat the adhesion portion 12*a* of the frost layer F without providing an additional installation in the existing cooling space, and thus it is possible to reduce the cost.

Figure 5:
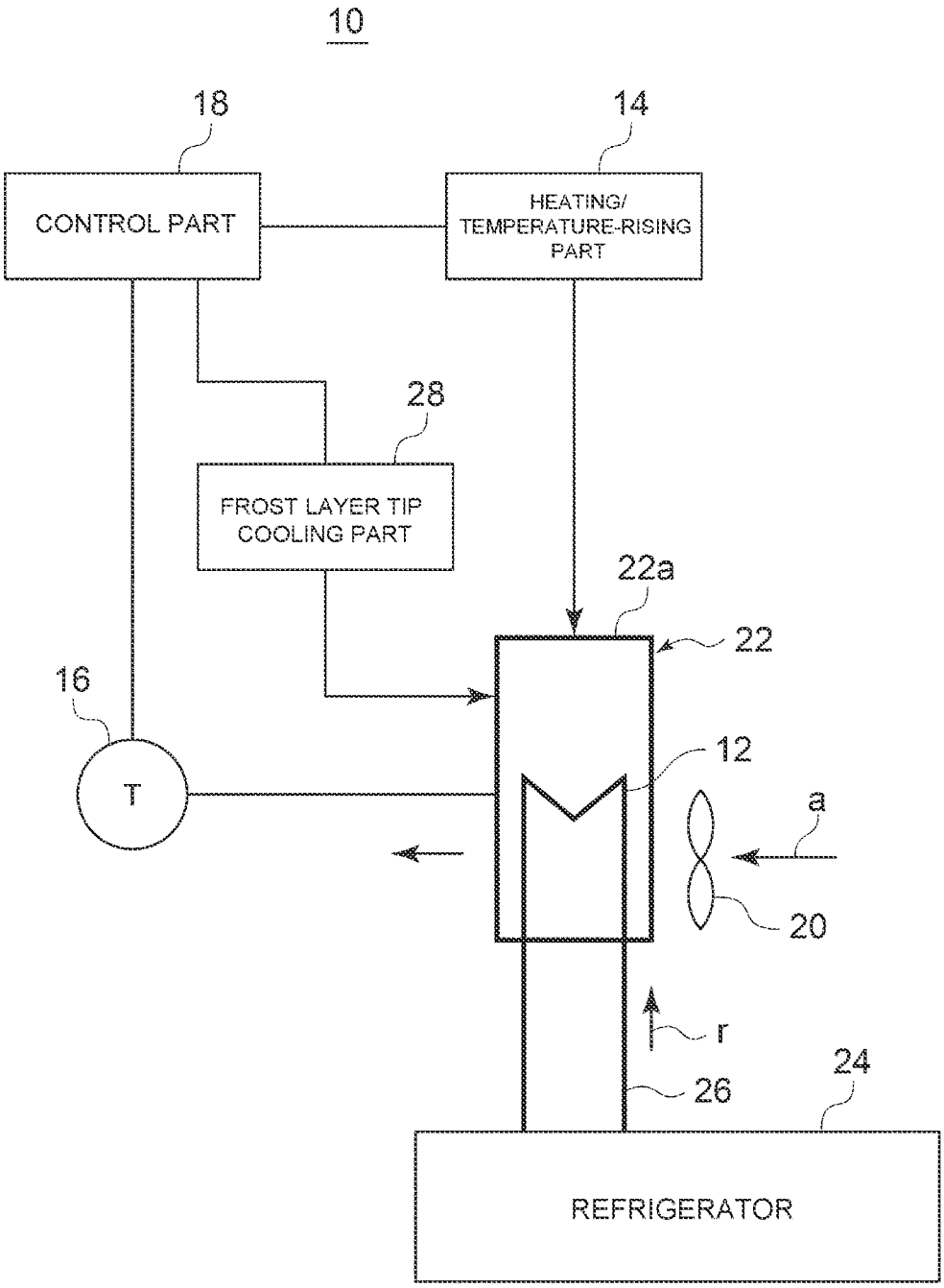
FIG. 5 is a block diagram of a defrosting device according to an embodiment.

A defrosting device 10 according to an embodiment includes, as shown in FIG. 5, a heating/temperature-rising part 14 for rising the temperature of the adhesion portion of the cooling surface 12*a*, to which the frost layer F adheres, at the time of defrosting. The heating/temperature-rising part 14 has a heat source located on the adhesion portion 12*a* side with respect to the frost layer F. Additionally, the device includes a temperature sensor 16 for detecting the temperature of the adhesion portion 12*a*, and detection results of the temperature sensor 16 are input into a control part 18. The control part 18 operates the heating/temperature-rising part 14 so as to rise the temperature of the adhesion portion 12*a* under a temperature condition below the melting point of the frost layer F and form a temperature gradient in which the temperature decreases toward the tip-side region Ft from the root-side region Fr to the tip-side region Ft.

The defrosting device 10 removes the frost layer F adhering to the cooling surface 12*a* for cooling the to-be-cooled gas a.

In the above configuration, the adhesion portion 12*a* is heated and its temperature is raised with the heating/temperature-rising part 14 so as to establish conditions where sublimation can occur around the adhesion portion 12*a*. Thus, sublimation mainly occurs around the root-side region Fr.

In the heating/temperature-rising step S10, the control part 18 forms a temperature gradient where the temperature gradually decreases from the root-side region Fr to the tip-side region Ft, like lines $A_1$ to $A_3$ and lines $B_1$ to $B_3$ shown in FIG. 3, based on the detection results of the temperature sensor 16.

The formation of the temperature gradient causes sublimation around the root-side region Fr, consequently reducing the adhesion area where the root-side region Fr adheres to the adhesion portion 12*a*. This reduces the adhesion strength of the frost layer F and facilitates defrosting.

The frost layer may be eliminated by continuing the sublimation or may be peeled from the adhesion portion 12*a* by applying physical action such as scraping, vibration, gravity, or electromagnetic to the frost layer whose adhesion strength is reduced.

With the above configuration, it is possible to remove frost on the adhesion portion 12*a* without considerably disturbing cooling of the to-be-cooled material, and it is unnecessary to remove melt water since melt water is not generated during defrosting. Additionally, since the root-side region Fr of the frost layer F is mainly sublimated, it is possible to reduce the amount of heat necessary for sublimation, and it is possible to shorten the defrosting time. Thus, it is possible to improve the defrosting efficiency.

Further, since the frost layer F can be rooted up with the root-side region Fr, it is possible to prevent the frost layer F from clogging a space between cooling flow paths 12. This can eliminate a wide distance between the cooling flow paths, thus making the cooling device having the cooling flow paths 12 compact.

In an embodiment, as shown in FIG. 5, the cooling flow path 12 is provided within a casing 22*a* of a cooler 22. The cooling flow path 12 is connected to a refrigerator 24 via a refrigerant pipe 26. The refrigerant r flows from the refrigerator 24 via the refrigerant pipe 26 to the cooling flow path 12. In the cooler 22, the refrigerant r circulating through the cooling flow path 12 cools the cooling surface 12*a* to a temperature below freezing point, thereby cooling the to-be-cooled gas a to a temperature below freezing point.

For instance, the cooling flow path 12 may be a cooling pipe, and the cooling surface 12*a* may be an outer surface of the cooling pipe. The to-be-cooled gas a may be for instance air. A flow formation part 20 forms a flow of the to-be-cooled gas a. The flow of the to-be-cooled gas a is generated inside the casing 22*a*, and the to-be-cooled gas a is brought into contact with the cooling surface 12*a* and then cooled.

In an embodiment, as shown in FIG. 5, the defrosting device 10 further includes a frost layer tip cooling part 28 for cooling the tip-side region Ft of the frost layer F. The control part 18 operates the frost layer tip cooling part 28 so as to cool the tip-side region Ft and thereby forms the temperature distribution in which the temperature decreases from the root-side region Fr toward the tip-side region Ft between the root-side region Fr and the tip-side region Ft.

The frost layer tip cooling part 28 ensures to cool the tip-side region Ft and thus enables the above temperature distribution to be formed reliably.

Figure 6:
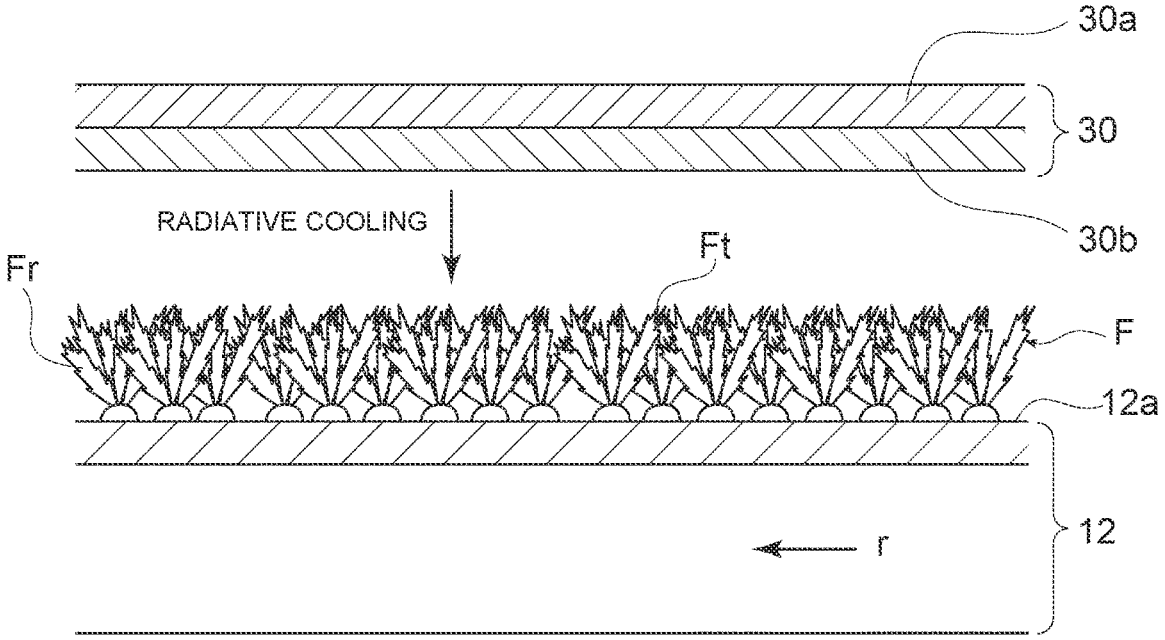
FIG. 6 is a cross-sectional view of a defrosting device according to an embodiment.

In an embodiment, as shown in FIG. 6, the frost layer tip cooling part 28 is a Peltier device 30 disposed to face the frost layer F formed on the adhesion portion 12*a*. The Peltier device 30 is composed of a heating portion 30*a* and a cooling portion 30*b*, and the cooling portion 30*b* is disposed to face the frost layer F.

The tip-side region Ft of the frost layer F is cooled by radiative cooling from the cooling portion 30*b* of the Peltier device 30, which makes it easy to form the above temperature distribution.

In an embodiment, as shown in FIG. 5, the defrosting device 10 includes a flow formation part 20 for forming a flow of the to-be-cooled gas a along the cooling surface 12*a*.

In an embodiment, the flow formation part 20 is a blower.

The flow formation part 20 enables, before the adhesion area where the root-side region Fr adheres to the adhesion portion 12*a* is made zero, the frost layer F with a reduced adhesion area to be peeled off with the root-side region Fr by the wind pressure due to the flow of the to-be-cooled gas a. Thus, it is possible to reduce the amount of heat necessary for sublimation. Further, it is possible to shorten the defrosting time and improve the defrosting efficiency.

Figure 7:
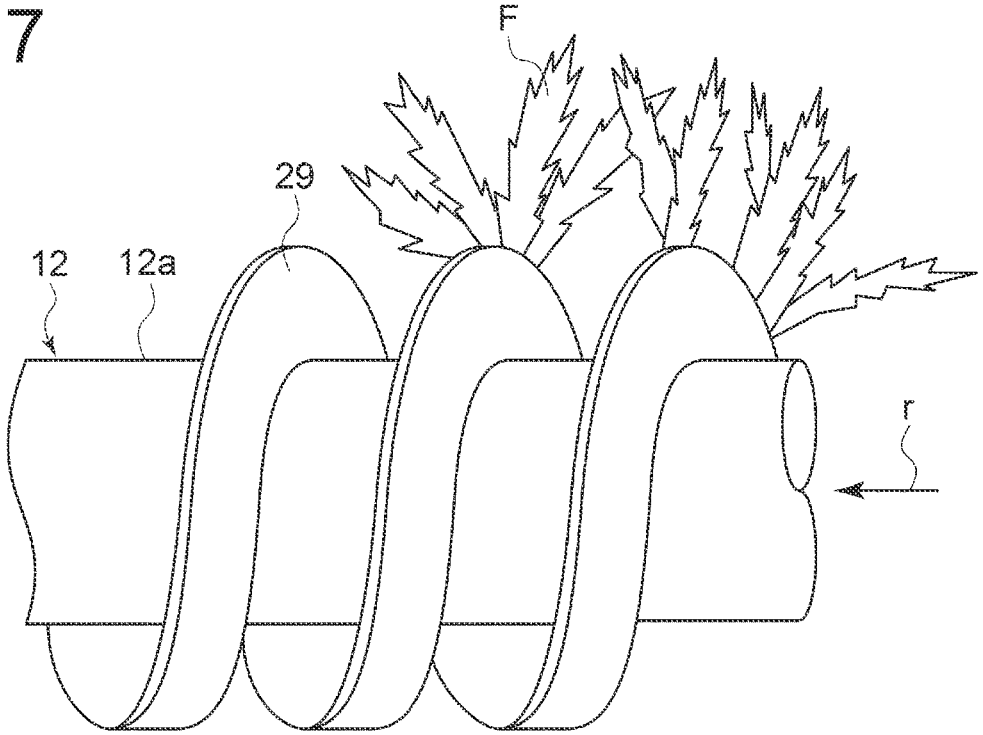
FIG. 7 is a perspective view of a cooling flow path according to an embodiment.

In an embodiment, as shown in FIG. 7, a heat transfer portion 29 is formed integrally with the surface of the cooling pipe serving as the cooling flow path 12.

The heat transfer portion 29 on the surface of the cooling pipe increases an area of the cooling surface 12*a*, thus improving the cooling effect of the to-be-cooled gas a. Further, since the frost layer F is dispersedly generated on the cooling surface 12*a* and the heat transfer portion 29, it is possible to prevent the flow path of the to-be-cooled gas a between the cooling flow paths 12 from being clogged.

In the illustrated embodiment, the heat transfer portion 29 is a radiation fin in a spiral shape wound around an outer peripheral surface of the cooling pipe.

Figure 8:
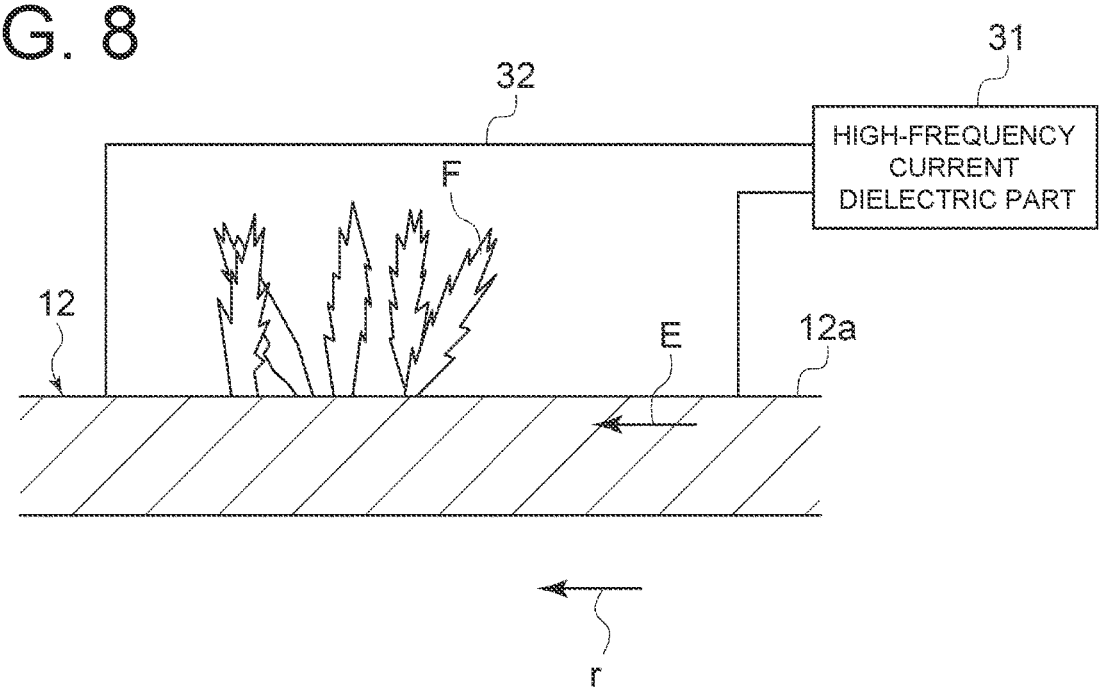
FIG. 8 is a cross-sectional view of a defrosting device according to an embodiment.

In an embodiment, as shown in FIG. 8, the heating/temperature-rising part 14 includes a high-frequency current dielectric part 31. The high-frequency current dielectric part 31 is connected to the cooling surface 12*a* of the cooling flow path 12 via a conductive wire 32.

In the heating/temperature-rising step S10, a high-frequency current E may be applied from the high-frequency current dielectric part 31 to the cooling flow path 12 so that the high-frequency current E concentrates on the cooling surface 12*a* by the skin effect.

This improves the heating effect of the frost layer F adhering to the cooling surface 12*a* and allows the high-frequency current E to concentrate on the cooling surface 12*a*, thus saving energy.

Figure 9:
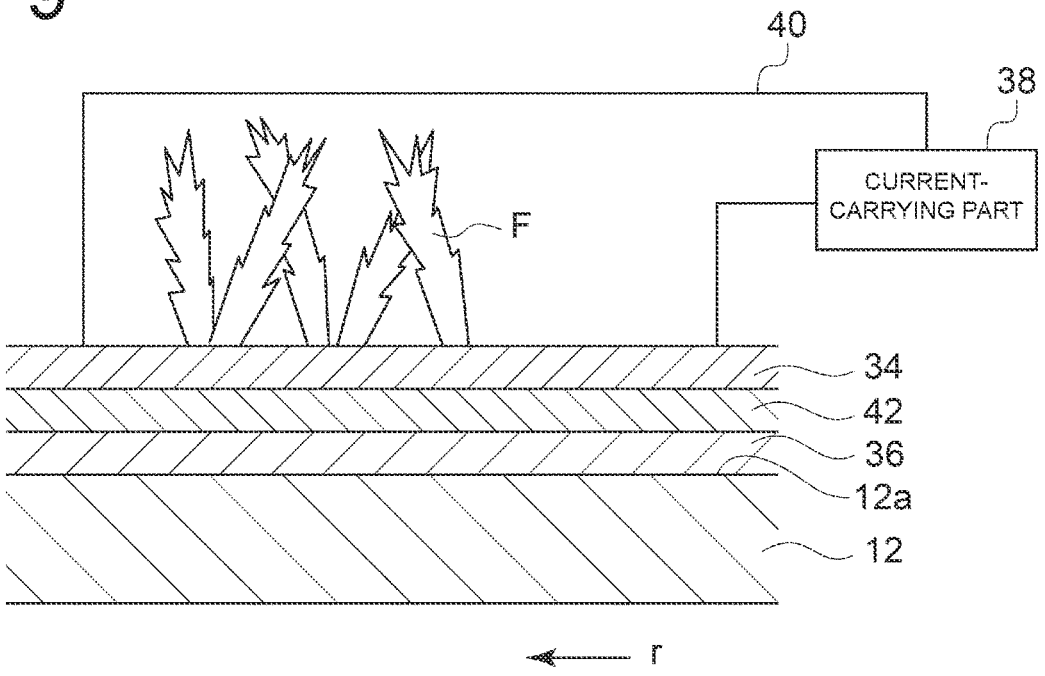
FIG. 9 is a cross-sectional view of a defrosting device according to an embodiment.

In an embodiment, as shown in FIG. 9, the device includes an electrically conductive material layer 34 formed on the cooling surface 12*a*, and an electrically insulating layer 36 formed between the electrically conductive material layer 34 and the cooling flow path 12. Further, the device includes, as the heating/temperature-rising part 14, a current-carrying part 38 which applies a current to the electrically conductive material layer 34 via a conductive wire 40.

In the above configuration, in the heating/temperature-rising step S10, a current is applied from the current-carrying part 38 to the electrically conductive material layer 34 to heat the electrically conductive material layer 34, and the heated electrically conductive material layer 34 rises the temperature of the frost layer F adhering to the surface of the electrically conductive material layer 34.

With the above configuration, the electrically insulating layer 36 allows the current to concentratedly flow through the electrically conductive material layer 34 during defrosting. Additionally, thinning the electrically conductive material layer 34 reduces thermal energy required for heating, thus saving energy.

In an embodiment, the electrically conductive material layer 34 is a conductive plating layer which is formed to cover the surface of the electrically insulating layer 36 by an electroplating process. In this example, since the conductive plating layer cannot directly coat the surface of the electrically insulating layer 36, as shown in FIG. 9, the surface of the electrically insulating layer 36 needs to be coated with an electrically conductive resin coating layer 42 for surface preparation. The electrically conductive resin coating layer 42 may be formed on the surface of the electrically insulating layer 36 by, for instance, electro-deposition coating.

The conductive plating layer formed by plating can have a uniform film thickness. The electrically conductive material layer 34 composed of the conductive plating layer with a uniform thickness allows uniform current to flow therethrough from current-carrying part 38, thus heating the cooling surface 12*a* uniformly. Additionally, thinning the conductive plating layer reduces the heat amount for heating the conductive plating layer.

In this embodiment, the current can concentratedly flow through the conductive plating layer, and the conductive plating layer can be made thin by plating. Thus, it is possible to reduce electric energy and save energy. Further, the cooling surface 12*a* can be heated to an appropriate temperature by adjusting the applied voltage and the energizing time of the current-carrying part 38.

In an embodiment, the electrically conductive material layer 34 may be formed by, for instance, an electroless plating method or a vapor deposition method. In a case where the electrically conductive material layer 34 is formed on the cooling surface 12*a* by the electroless plating method, the vapor deposition method, or the like, an electrically conductive coating for surface preparation, such as the electrically conductive resin coating layer 42 shown in FIG. 9, is unnecessary. Thus, the electrically conductive material layer 34 can directly coat the electrically insulating layer 36, and it is possible to reduce the time and the cost for surface preparation.

Figure 10:
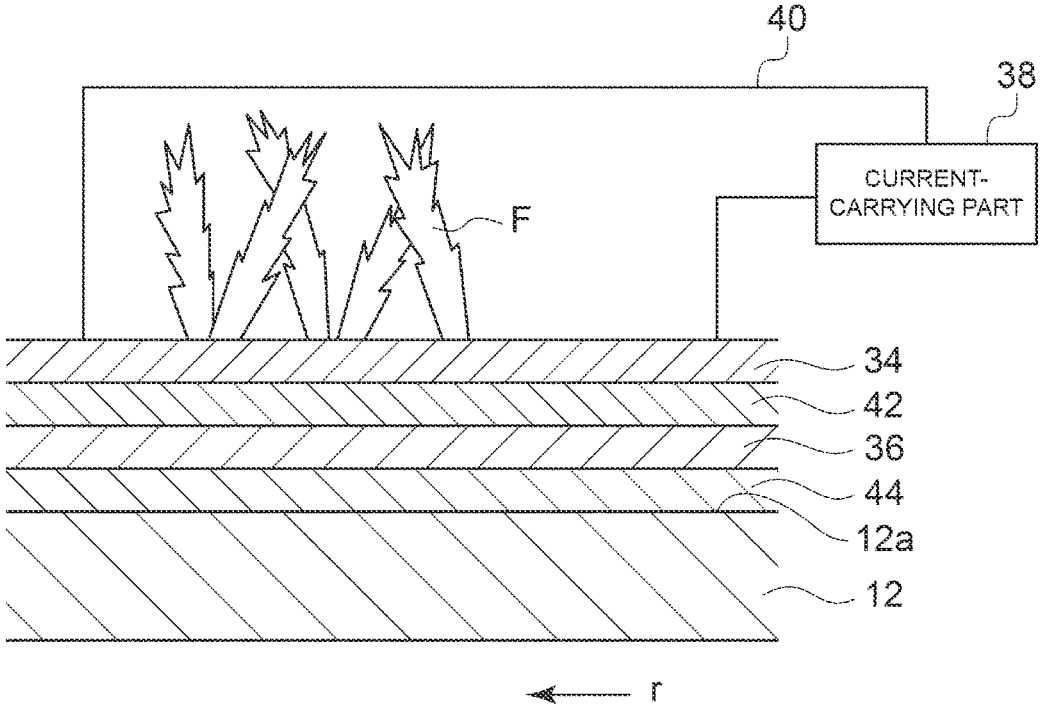
FIG. 10 is a cross-sectional view of a defrosting device according to an embodiment.

In an embodiment, as shown in FIG. 10, a heat insulating layer 44 (e.g., heat insulating layer composed of a polyimide resin) is interposed between the electrically insulating layer 36 and the cooling surface 12*a*. The configuration is otherwise the same as that of the embodiment shown in FIG. 9.

In the above configuration, the heat insulating layer 44 suppresses heat transfer from the heated electrically conductive material layer 34 to the cooling flow path 12 and thereby dramatically improves the temperature rising rate and the thermal efficiency of the cooling surface 12*a* during defrosting. Further, minimizing the thickness of the heat insulating layer 44 prevents the reduction in cooling efficiency during cooling operation. That is, cooling the to-be-cooled gas a during cooling operation predominantly depends on a heat transfer coefficient of the gas, and thermal conduction in the heat insulating layer 44 does not significantly affect it. For instance, if the heat insulating layer 44 composed of the polyimide resin has a thickness of a few to hundred μm approximately, the reduction in heat transfer can be suppressed within several percent.

In the embodiment shown in FIG. 10, as in the embodiment shown in FIG. 9, the electrically conductive material layer 34 is a conductive plating layer, and the conductive plating layer is formed to cover the surface of the electrically insulating layer 36 through the electroplating process. In this case, since the conductive plating layer cannot directly coat the surface of the electrically insulating layer 36, the surface of the electrically insulating layer 36 needs to be coated, for instance, with the electrically conductive resin coating layer 42 for surface preparation.

On the other hand, if the electrically conductive material layer 34 is formed by, for instance, the electroless plating method or the vapor deposition method, an electrically conductive coating for surface preparation such as the electrically conductive resin coating layer 42 is unnecessary. Thus, the electrically conductive material layer 34 can directly coat the electrically insulating layer 36, and it is possible to reduce the time and the cost for surface preparation.

In an embodiment, a single layer composed of a material with electrically insulating property and low thermal conductivity may be used to act as both the electrically insulating layer 36 and the heat insulating layer 44. Thereby, it is possible to make formation of the cooling flow path 12 easy and less expensive.

Figure 11:
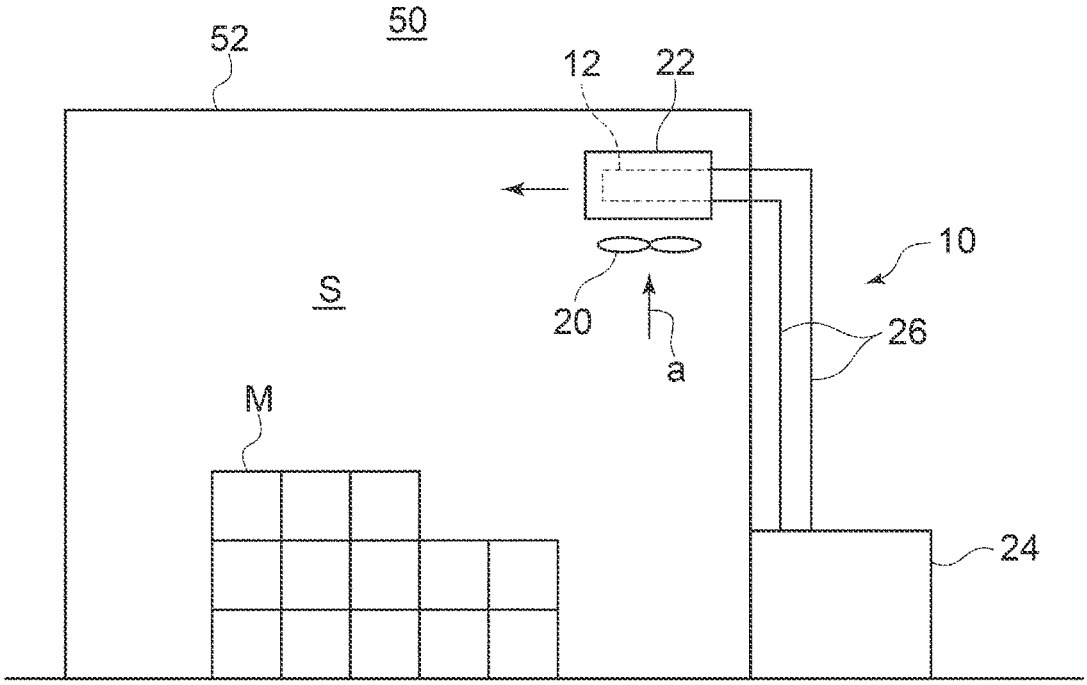
FIG. 11 is a schematic diagram of a cooling device according to an embodiment.

A cooling device 50 according to an embodiment includes, as shown in FIG. 11, a housing 52 in which a cooling space S is formed. A cooler 22 is provided within the housing 52. The cooling surface 12*a* is formed within a housing of the cooler 22. The cooling surface 12*a* is formed at an outer surface of the cooling flow path 12. Further, the defrosting device 10 with the above configuration is provided in the cooler 22. In the cooling space S, a to-be-cooled material M, such as food products to be preserved in cold, is stored.

In this configuration, when the cooling surface 12*a* of the cooling flow path 12 is defrosted, the defrosting device 10 with the above configuration allows the frost layer F adhering to the cooling surface 12*a* to be removed without stopping the cooling device 50 under operation. Additionally, since melt water is not generated, it is unnecessary to remove the melt water.

Additionally, since the root-side region Fr of the frost layer F is mainly sublimated by the defrosting device 10, it is unnecessary to sublimate the whole frost layer. Thus, it is possible to reduce the necessary heat amount, and it is possible to shorten the defrosting time and improve the defrosting efficiency.

Further, since the frost layer F can be rooted up with the root-side region Fr, there is no risk that the frost layer F clogs a space between cooling flow paths 12. This can eliminate a wide distance between the cooling flow paths, thus making the cooler containing the cooling flow paths 12 compact.

WORKING EXAMPLE

First Example

A defrosting experiment including the steps shown in FIG. 1 was performed on a frost layer formed on a vertically transverse flat plate resembling the orientation of a general fin of an air heat exchanger.

In the heating/temperature-rising step S10, the Peltier device was used to heat the flat plate and rise the temperature of the flat plate. In the cooling step S12, cooled air was used as the cooling source. In the peeling step S16, the flow of the cooled air was used to peel off the frost layer.

The experimental conditions were as follows: the frost formation time was 1 hour; the wind speed of the cooled air was constant (3 m/s) in all steps; and the temperature of the cooling surface in the heating/temperature-rising step S10 was −5° C. When the temperature of the cooled air was −5° C., the temperature of the cooling surface in the heating/temperature-rising step S10 was −1.5° C. The temperature and the humidity of the cooled air at the time of frost formation and heating/temperature rising (on the basis of saturation vapor pressure of ice) were used as parameters to perform examination.

Figure 12:
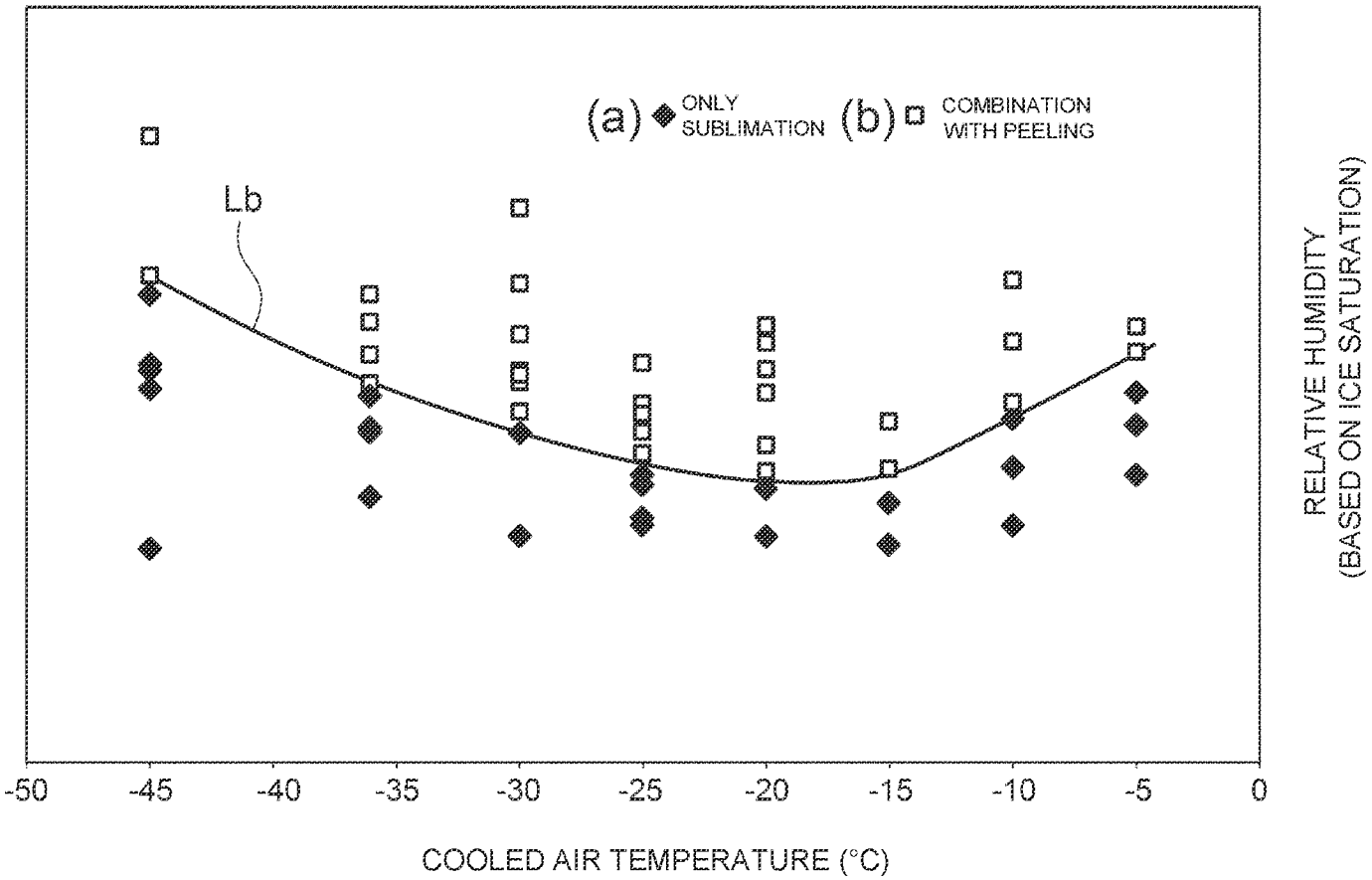
FIG. 12 is a graph showing defrosting results according to an embodiment.

The results are shown in FIG. 12. In this figure, (a) shows a case where sublimation of the entire frost layer dominates over the reduction in adhesion area, and defrosting is achieved only by sublimation without peeling; (b) shows a case where the reduction in adhesion area dominates, and defrosting is achieved with peeling. In both cases, the frost layer on the cooling surface could be removed.

Also, as can be seen from the figure, the boundary line Lb between (a) and (b) is convex downward such that the temperature of the cooled air is around −20° C. in the bottom. The lower the temperature, the slower the growth speed of the frost layer; the higher the temperature, the higher the density of the frost layer. The reason why the boundary line Lb is convex downward is considered due to these factors.

Second Example

A defrosting experiment including the steps shown in FIG. 1 was performed on a frost layer formed on the same flat plate as in the first example.

In the heating/temperature-rising step S10, the Peltier device was used to heat and rise the temperature of the same vertically transverse flat plate as in the first example. In the cooling step S12, the cooled air was used as the cooling source. In the peeling step S16, the flow of the cooled air was used to peel off the frost layer.

The experimental conditions were as follows: the relative humidity of the cooled air was substantially constant under saturated to supersaturated conditions (about 98% to 133%) on the basis of saturated vapor pressure of ice; and the wind speed of the cooled air was constant (3 m/s) in all steps. The temperature of the cooling surface in the heating/temperature-rising step S10 was −5° C. When the temperature of the cooled air was −5° C., the temperature of the cooling surface in the heating/temperature-rising step S10 was −1.5° C. The frost formation time and the temperature of the cooled air at the time of frost formation and heating/temperature rising were used as parameters to perform examination.

Figure 13:
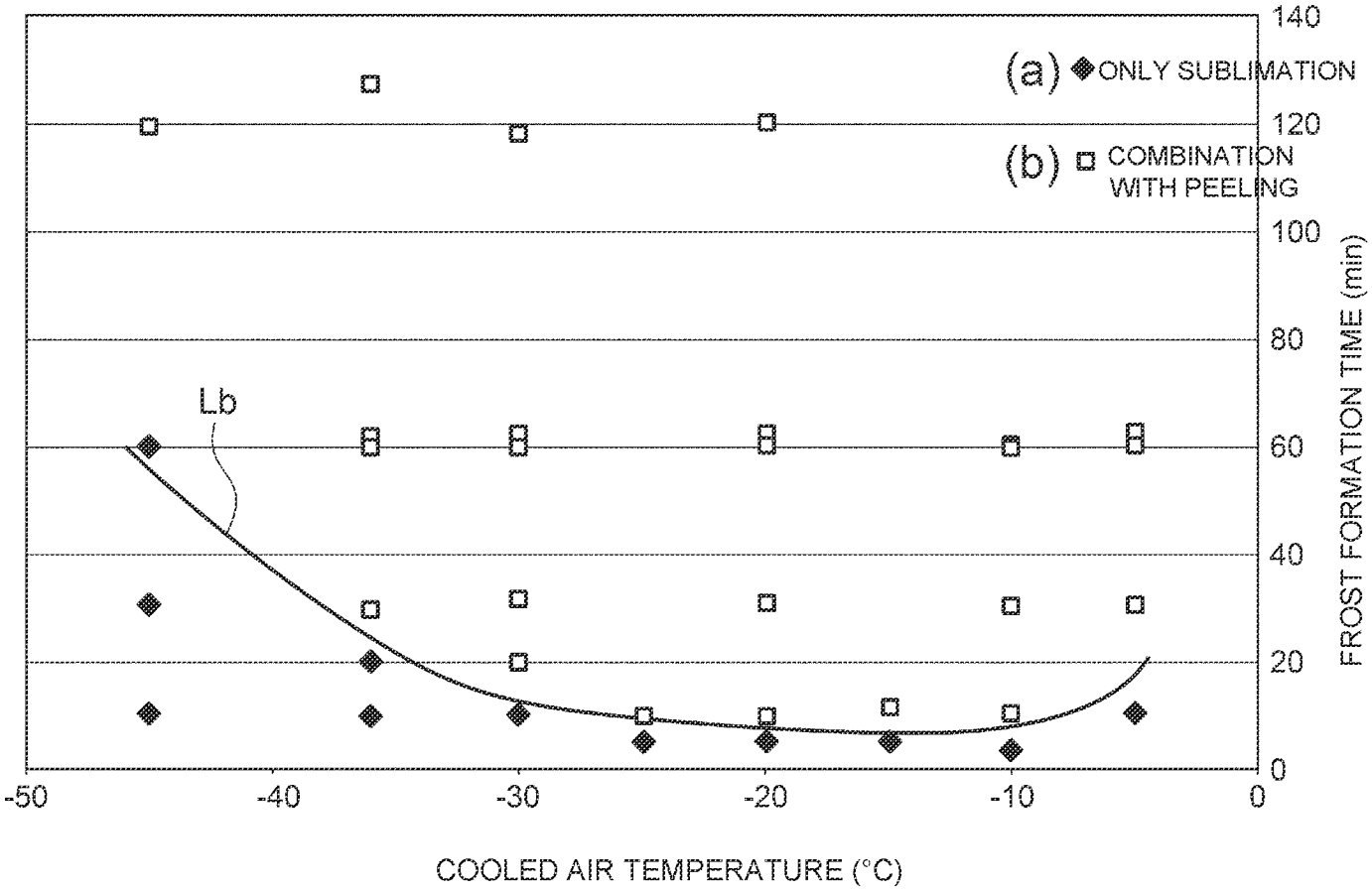
FIG. 13 is a graph showing defrosting results according to an embodiment.

The results are shown in FIG. 13. In this figure, (a) shows a case where sublimation of the entire frost layer dominates over the reduction in adhesion area, and defrosting is achieved only by sublimation without peeling; (b) shows a case where the reduction in adhesion area dominates, and defrosting is achieved with peeling. In both cases, the frost layer on the cooling surface could be removed.

The figure also shows the tendency where the longer the frost formation time, that is, the higher the height of the frost layer, the easier peeling is accompanied. Also in this example, the boundary line Lb is convex downward. This reason is also considered the difference in growth and the difference in density due to the temperature of the frost layer, as in the first example.

Figure 14:
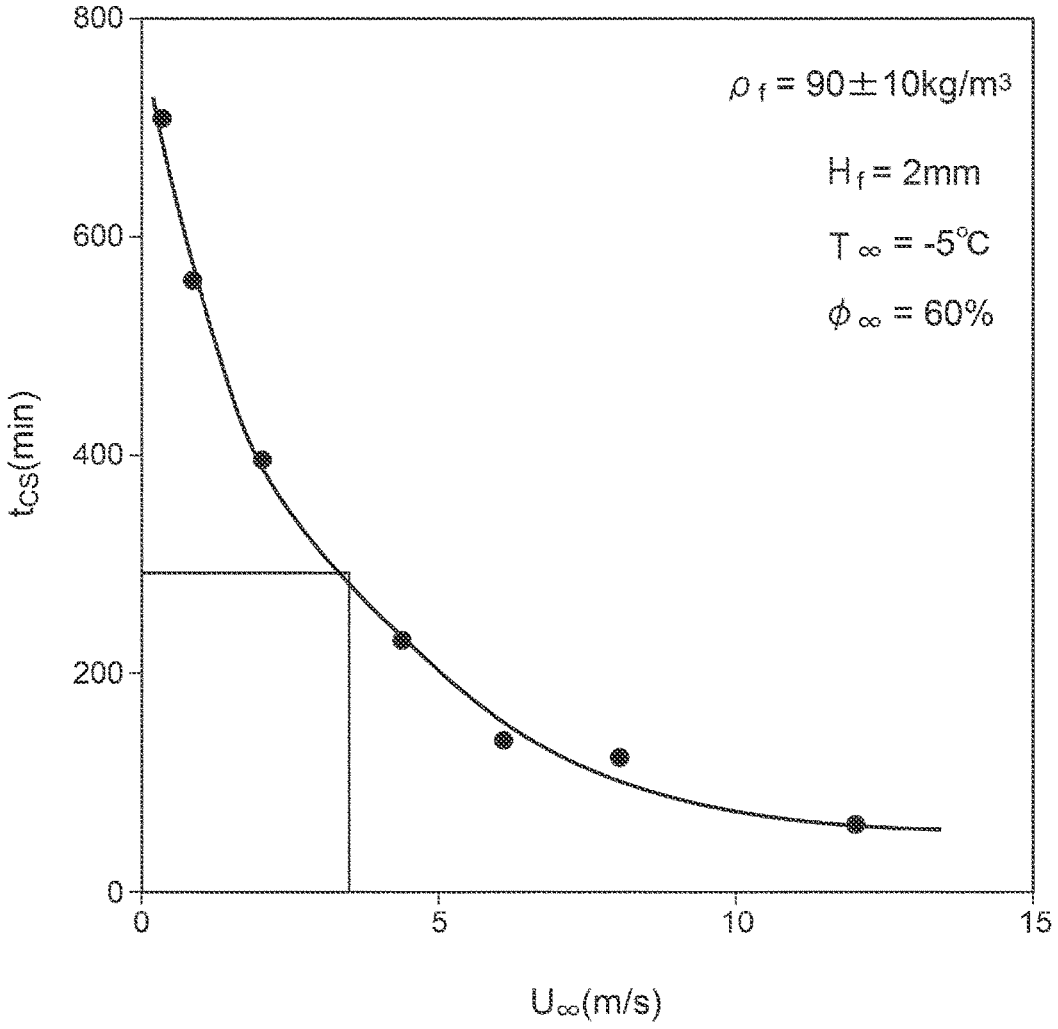
FIG. 14 is a diagram showing defrosting results of a sublimation defrosting method of a comparative example.

FIG. 14 shows FIG. 8 of Inaba, Imai, et al., "Study on Defrosting by means of Sublimation Phenomenon (1st Report, Sublimation Phenomenon of a Horizontal Frost Layer Exposed to Forced Convection Air Flow", Transactions of the Japan Society of Mechanical Engineers, Series B, Vol. 61, No. 585, (1995-5). FIG. 14 shows a relationship between the heated air flow and the sublimation time and describes results of experimental study in which defrosting sublimation was performed by heating the air flow.

The experimental conditions were as follows: the thickness of the frost layer at the beginning of sublimation was 2 mm; the temperature of the air was −5° C.; the relative humidity of the air flow was 60%; and the adhesion portion side of the frost layer was thermally insulated. In this experiment, it took about 300 minutes (5 hours) to complete defrosting at a wind speed of about 3 m/s.

By contrast, in an example of the defrosting method according to an embodiment, a frost layer (with a thickness of about 1 mm) was formed in a frost formation time of 2 hours under conditions where the air temperature was about −36° C., the cooling flat plate surface temperature was about −45° C., the wind speed was about 3 m/s, and the relative humidity was about 140% (supersaturation). This frost layer took about 2.5 to 3 minutes to start peeling off by the cooled air flow with the decrease in adhesion strength, under conditions where the air temperature during defrosting was about −36° C., the cooling flat plate surface temperature was raised and then kept at about −5° C., the wind speed was about 3 m/s, and the relative humidity was about 140% (supersaturation). In this way, it was possible to achieve defrosting in a short time without increasing the air temperature even under supersaturation conditions.

INDUSTRIAL APPLICABILITY

According to some embodiments, it is possible to improve the defrosting efficiency with low-cost means in a sublimation defrosting method which allows defrosting without stopping the operation of the cooling device.

It will be apparent to those skilled in the art that various modifications and variations can be made to the structure of the disclosure without departing from the scope or spirit of the disclosure. In view of the foregoing, it is intended that the disclosure covers modifications and variations of the disclosure provided they fall within the scope of the following claims and their equivalents.

The invention claimed is:

1. A sublimation defrosting device for removing a frost layer adhering to a cooling surface for cooling a to-be-cooled gas; the device comprising:

a heating/temperature-rising part configured to heat an adhesion portion of the cooling surface, to which the frost layer adheres, to rise a temperature of the adhesion portion, with a heat source located on an adhesion portion side with respect to the frost layer;

a temperature sensor for detecting the temperature of the adhesion portion; and a control part into which a detection value of the temperature sensor is input and which operates the heating/temperature-rising part so as to rise the temperature of the adhesion portion under a temperature condition below a melting point of the frost layer and form a temperature gradient from a root-side region to a tip-side region of the frost layer, wherein the control part is configured to control the heating/temperature-rising part such that the frost layer has a temperature distribution in which a tip of the frost layer has a temperature lower than the adhesion portion and the frost layer has a region whose temperature is lower than the tip of the frost layer, during transient change due to heating and temperature-rising caused by the heating/temperature-rising part.

2. The sublimation defrosting device according to claim 1, comprising a cooling part configured to cool the tip-side region of the frost layer, wherein the control part is configured to operate the cooling part so as to cool the tip-side region and thereby form the temperature gradient.

3. The sublimation defrosting device according to claim 1, further comprising a flow formation part for forming a flow of the to-be-cooled gas along the cooling surface.

4. The sublimation defrosting device according to claim 1, wherein the heating/temperature-rising part is a high-frequency current dielectric part configured to apply a high-frequency current to the adhesion portion.

5. A cooling device comprising:

a housing which forms a cooling space therein;

a cooler which has a cooling surface for cooling the a to-be-cooled gas and forms the cooling space by the cooling surface; and the sublimation defrosting device according to claim 1, wherein the cooling device is configured to cool a to-be-cooled material contained in the cooling space.

6. The sublimation defrosting device according to claim 1, comprising:

an electrically conductive material layer formed on the adhesion portion; and an electrically insulating layer formed between the electrically conductive material layer and a cooling flow path which forms the cooling surface, wherein the heating/temperature-rising part includes a current-carrying part configured to apply a current to the electrically conductive material layer.

7. The sublimation defrosting device according to claim 6, further comprising a heat insulating layer interposed between the electrically insulating layer and the cooling flow path.

8. A sublimation defrosting device for removing a frost layer adhering to a cooling surface for cooling a to-be-cooled gas; the device comprising:

a heating/temperature-rising part configured to heat an adhesion portion of the cooling surface, to which the frost layer adheres, to rise a temperature of the adhesion portion, with a heat source located on an adhesion portion side with respect to the frost layer; and a cooling part disposed to face the adhesion portion and configured to cool the tip-side region of the frost layer, wherein the sublimation defrosting device is configured such that the heating/temperature-rising part rises the temperature of the adhesion portion under a temperature condition below a melting point of the frost layer while the cooling part cools the tip-side region of the frost layer to form a temperature gradient from a root-side region to a tip-side region of the frost layer.

9. A sublimation defrosting method for removing a frost layer adhering to a cooling surface for cooling a to-be-cooled gas; the method comprising a heating/temperature-rising step of heating an adhesion portion of the cooling surface, to which the frost layer adheres, to rise a temperature of the adhesion portion by a heat source located on an adhesion portion side with respect to the frost layer, under a temperature condition below a melting point of the frost layer, wherein the heating/temperature-rising step is performed by a heating/temperature- rising part, the temperature of the adhesion portion is detected by a temperature sensor, a detection value of the temperature sensor is input into a control part, the control part operates the heating/temperature-rising part so as to rise the temperature of the adhesion portion under the temperature condition below the melting point of the frost layer and form a temperature gradient from a root-side region to a tip-side region of the frost layer, the control part controls the heating/temperature-rising part such that the frost layer has a temperature distribution in which a top of the frost layer has a temperature lower than the adhesion portion and the frost layer has a region whose temperature is lower than the tip of the frost layer, during transient change due to heating and temperature-rising caused by the heating/temperature-rising part.

10. The sublimation defrosting method according to claim 9, further comprising a cooling step of keeping the tip-side region of the frost layer adhering to the adhesion portion at a lower temperature than a raised temperature of the adhesion portion.

11. The sublimation defrosting method according to claim 9, wherein in the heating/temperature-rising step, a temperature rising rate of the adhesion portion is increased as a temperature of the frost layer increases.

12. The sublimation defrosting method according to claim 9, wherein in the heating/temperature-rising step, a temperature rising rate of the adhesion portion is increased as a thickness of the frost layer decreases.

13. The sublimation defrosting method according to claim 9, wherein in the heating/temperature-rising step, instantaneous temperature-rising is intermittently performed on the adhesion portion.

14. The sublimation defrosting method according to claim 9, wherein in the heating/temperature-rising step, the temperature of the adhesion portion is raised by supplying a heated refrigerant to a cooling flow path which forms the cooling surface.

15. The sublimation defrosting method according to claim 9, further comprising a sublimation step of sublimating the root-side region of the frost layer adhering to the adhesion portion heated in the heating/temperature-rising step so as to reduce an adhesion area where the root-side region adheres to the adhesion portion.

16. The sublimation defrosting method according to claim 15, wherein the cooling step includes keeping the tip-side region of the frost layer at a lower temperature than the adhesion portion by a cooling space formed around the cooling surface.

17. The sublimation defrosting method according to claim 16, wherein the adhesion portion is divided into a plurality of sections, and wherein the heating/temperature-rising step and the sublimation step are performed for each of the plurality of sections while the cooling space is formed around the cooling surface by the cooling step.

18. The sublimation defrosting method according to claim 15, further comprising a peeling step of applying physical force to the frost layer with the adhesion area reduced by the sublimation step to peel off the frost layer from the adhesion portion.

19. The sublimation defrosting method according to claim 18, wherein the peeling step includes forming a flow of the to-be-cooled gas along the adhesion portion and peeling off the frost layer from the adhesion portion by a wind pressure of the to-be-cooled gas.

* * * * *